US008157609B2

(12) United States Patent
Hallaian et al.

(10) Patent No.: US 8,157,609 B2
(45) Date of Patent: Apr. 17, 2012

(54) MIND-CONTROL TOYS AND METHODS OF INTERACTION THEREWITH

(75) Inventors: Stephen C. Hallaian, Long Beach, CA (US); Stephen P. K. Lau, Torrance, CA (US); Kam Young-eun Kim Redlawsk, Los Angeles, CA (US); Joseph W. Franke, Studio City, CA (US)

(73) Assignee: Mattel, Inc., El Segundo, CA (US)

( * ) Notice: Subject to any disclaimer, the term of this patent is extended or adjusted under 35 U.S.C. 154(b) by 267 days.

(21) Appl. No.: 12/589,255

(22) Filed: Oct. 19, 2009

(65) Prior Publication Data

US 2010/0105478 A1 Apr. 29, 2010

Related U.S. Application Data

(60) Provisional application No. 61/106,560, filed on Oct. 18, 2008, provisional application No. 61/204,651, filed on Jan. 7, 2009.

(51) Int. Cl.
*A63H 29/08* (2006.01)

(52) U.S. Cl. ..... 446/173

(58) Field of Classification Search ..... 446/173; 436/36; 273/460

See application file for complete search history.

(56) References Cited

U.S. PATENT DOCUMENTS

| | | | |
|---|---|---|---|
| 1,744,680 | A | 1/1930 | Sherrill |
| 1,824,388 | A | 9/1931 | Birch |
| 2,055,498 | A | 9/1936 | Jacobs |
| 2,118,609 | A | 5/1938 | Klug |
| 2,361,346 | A | 10/1944 | Atkins |
| 2,490,792 | A | 12/1949 | Kermit |
| 2,707,879 | A | 5/1955 | Dwyer |
| 2,903,817 | A | 9/1959 | McLain et al. |
| 2,911,745 | A | 11/1959 | Simon |
| 2,924,033 | A | 2/1960 | Lanctot |
| 3,083,497 | A | 4/1963 | Novak et al. |
| 3,115,343 | A | 12/1963 | Lemelson |
| 3,232,107 | A | 2/1966 | Busillo |
| 3,325,935 | A | 6/1967 | Holter |
| 3,342,068 | A | 9/1967 | Metzger |
| 3,416,370 | A | 12/1968 | Kaucher |
| 3,675,481 | A | 7/1972 | Phillips |
| 3,869,123 | A | 3/1975 | McDaniel |

(Continued)

FOREIGN PATENT DOCUMENTS

| | | |
|---|---|---|
| CA | 2555761 | 7/2005 |

(Continued)

*Primary Examiner* — Ronald Laneau
(74) *Attorney, Agent, or Firm* — Kolisch Hartwell, PC

(57) ABSTRACT

A mind-control toy is provided, comprising one or more biosensors configured to detect brainwave activity and generate signals based on the detected brainwave activity. A controller may be responsive to the signals to direct a member to effect movement of one or more objects. In some embodiments, the member includes a device for suspending the object in midair above the device, and the controller is responsive to the first signal to vary output of the device to control a suspended height of the object. In some such embodiments, the mind-control toy includes an obstacle course defining an aerial path. In other such embodiments, the mind-control toy includes a track along which players can compete or cooperate. In other embodiments, the mind-control toy includes a maze, a portion of which may be rotated using mind control to maneuver the object from a start zone to an end zone.

22 Claims, 9 Drawing Sheets

U.S. PATENT DOCUMENTS

| | | | |
|---|---|---|---|
| 3,887,182 | A | 6/1975 | Breslow |
| 3,974,857 | A | 8/1976 | Hehl |
| 4,045,906 | A | 9/1977 | Goldfarb et al. |
| 4,149,716 | A | 4/1979 | Scudder |
| 4,345,765 | A | 8/1982 | Wang |
| 4,358,118 | A | 11/1982 | Plapp |
| 4,564,195 | A | 1/1986 | McClure et al. |
| 4,858,921 | A | 8/1989 | Eustice et al. |
| 4,928,704 | A | 5/1990 | Hardt |
| 4,949,726 | A | 8/1990 | Hartzell et al. |
| 4,955,388 | A | 9/1990 | Silberstein |
| 5,011,144 | A | 4/1991 | Marello et al. |
| 5,016,213 | A | 5/1991 | Dilts et al. |
| 5,038,782 | A | 8/1991 | Gevins et al. |
| 5,145,176 | A | 9/1992 | Lipson |
| 5,163,690 | A | 11/1992 | Davis et al. |
| 5,186,675 | A | 2/1993 | Stoddard |
| 5,209,494 | A | 5/1993 | Spector |
| 5,213,338 | A | 5/1993 | Brotz |
| 5,314,368 | A | 5/1994 | Cheng |
| 5,377,100 | A | 12/1994 | Pope et al. |
| 5,381,719 | A | 1/1995 | Otsuka |
| 5,465,729 | A | 11/1995 | Bittman et al. |
| 5,470,081 | A | 11/1995 | Sato et al. |
| 5,474,082 | A | 12/1995 | Junker |
| 5,545,071 | A | 8/1996 | Shiraishi |
| 5,571,057 | A | 11/1996 | Ayers |
| 5,592,401 | A | 1/1997 | Kramer |
| 5,638,826 | A | 6/1997 | Wolpaw et al. |
| 5,692,517 | A | 12/1997 | Junker |
| 5,740,812 | A | 4/1998 | Cowan |
| 5,772,508 | A | 6/1998 | Sugita et al. |
| 5,794,364 | A | 8/1998 | Richmond |
| 5,974,262 | A | 10/1999 | Fuller et al. |
| 5,983,129 | A | 11/1999 | Cowan et al. |
| 6,001,065 | A | 12/1999 | DeVito |
| 6,045,341 | A | 4/2000 | Mak |
| 6,097,981 | A | 8/2000 | Freer |
| 6,190,314 | B1 | 2/2001 | Ark |
| 6,254,536 | B1 | 7/2001 | DeVito |
| 6,299,164 | B1 | 10/2001 | Yi |
| 6,382,808 | B1 | 5/2002 | Lin |
| 6,402,520 | B1 | 6/2002 | Freer |
| 6,450,820 | B1 | 9/2002 | Palsson et al. |
| 6,457,975 | B1 | 10/2002 | Miranda et al. |
| 6,529,773 | B1 | 3/2003 | Dewan |
| 6,599,164 | B1 | 7/2003 | Gerwitz et al. |
| 6,626,676 | B2 | 9/2003 | Freer |
| 6,672,930 | B1 | 1/2004 | McElhaney |
| 6,829,502 | B2 | 12/2004 | Hong et al. |
| 6,836,986 | B2 | 1/2005 | Ootsuta et al. |
| 7,048,604 | B2 | 5/2006 | Cusolito et al. |
| 7,260,430 | B2 | 8/2007 | Wu et al. |
| 7,331,870 | B2 | 2/2008 | Smith et al. |
| 2001/0056225 | A1 | 12/2001 | DeVito |
| 2002/0077534 | A1* | 6/2002 | DuRousseau ..... 600/300 |
| 2002/0143241 | A1 | 10/2002 | Thorell |
| 2003/0032888 | A1 | 2/2003 | Dewan |
| 2003/0100367 | A1 | 5/2003 | Cooke |
| 2004/0229702 | A1 | 11/2004 | Cooke |
| 2004/0230549 | A1 | 11/2004 | Freer |
| 2006/0129277 | A1 | 6/2006 | Wu |
| 2007/0016096 | A1 | 1/2007 | McNabb |
| 2007/0069471 | A1 | 3/2007 | Brattesani |
| 2007/0087813 | A1 | 4/2007 | Walker |
| 2007/0123350 | A1 | 5/2007 | Soderlund |
| 2007/0149282 | A1 | 6/2007 | Lu |
| 2007/0197292 | A1 | 8/2007 | Collura |
| 2007/0207858 | A1 | 9/2007 | Breving |
| 2007/0284825 | A1 | 12/2007 | Blagg |
| 2007/0298885 | A1 | 12/2007 | Tran |
| 2008/0081692 | A1 | 4/2008 | Pope |
| 2008/0161109 | A1 | 7/2008 | Chainer |
| 2008/0177197 | A1 | 7/2008 | Lee |
| 2008/0262335 | A1 | 10/2008 | Sun |
| 2008/0281221 | A1 | 11/2008 | Greco |
| 2008/0318673 | A1 | 12/2008 | Rofougaran |
| 2008/0318679 | A1 | 12/2008 | Tran |
| 2008/0318681 | A1 | 12/2008 | Rofougaran et al. |
| 2009/0036781 | A1 | 2/2009 | Utsugi |
| 2009/0069707 | A1 | 3/2009 | Sandford |
| 2009/0088659 | A1* | 4/2009 | Graham et al. ..... 600/545 |
| 2009/0156925 | A1 | 6/2009 | Jin |

FOREIGN PATENT DOCUMENTS

| | | |
|---|---|---|
| EP | 0177075 | 4/1986 |
| EP | 968743 | 1/2000 |
| GB | 2364253 | 1/2002 |
| JP | 06296757 | 10/1994 |
| JP | 10057355 | 3/1998 |
| JP | 10258183 | 9/1998 |
| JP | 11057207 | 3/1999 |
| JP | 2002166050 | 6/2002 |
| JP | 2002236096 | 8/2002 |
| JP | 2005144124 | 6/2005 |
| WO | 9101100 | 2/1991 |
| WO | 9910058 | 3/1999 |
| WO | 0107128 | 2/2001 |
| WO | 2005065544 | 7/2005 |
| WO | 2005065794 | 7/2005 |
| WO | 2007064603 | 6/2007 |
| WO | 2008091323 | 7/2008 |

* cited by examiner

MIND-CONTROL TOYS AND METHODS OF INTERACTION THEREWITH

CROSS REFERENCE TO RELATED APPLICATIONS

This application claims priority under 35 U.S.C. §119(e) to U.S. Provisional Patent Application Nos. 61/106,560, filed on Oct. 18, 2008, entitled "TOY," and 61/204,651, filed on Jan. 7, 2009, entitled "TOY." The disclosures of these provisional applications are incorporated herein by reference.

BACKGROUND

Toys exist that allow a user to maneuver an object through a labyrinth or maze. Examples of maze toys in which objects are maneuvered by tilting and/or rotating the maze are found in U.S. Pat. No. 2,562,126, U.S. Pat. No. 3,844,562, U.S. Pat. No. 4,219,195, U.S. Pat. No. 4,685,679, U.S. Pat. No. 5,042,808, U.S. Pat. No. 5,213,325, U.S. Pat. No. 6,371,853, and U.S. Pat. No. 7,011,308. Examples of water maze toys are found in U.S. Pat. No. 4,142,724 and U.S. Pat. No. 4,489,939. Examples of aerial maze toys are found in U.S. Pat. No. 7,048,604.

Examples of mind-control devices, toys and games are found in the following patents and patent application publications: U.S. Pat. No. 4,358,118, U.S. Pat. No. 5,213,338, U.S. Pat. No. 5,983,129, U.S. Pat. No. 6,097,981, U.S. Pat. No. 6,190,314, US20070069471, US20070123350, US20080081692, US20080177197 and US20090156925. The disclosures of all the patent applications, patents and other publications recited in this application are incorporated herein by reference in their entirety for all purposes.

DETAILED DESCRIPTION

Figure 1:
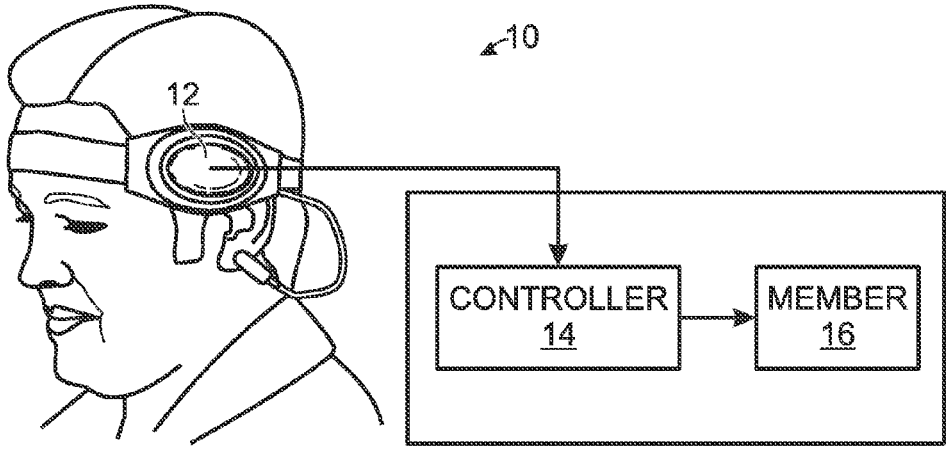
FIG. 1 depicts schematically an example mind-control toy.

FIG. 1 depicts schematically a mind-control toy 10 that includes a biosensor 12 configured to detect brainwave activity and generate a first signal based on the detected brainwave activity, and a controller 14 responsive to the first signal to direct a member 16 to effect movement of an object 18. Brainwave activity may be detected using various mechanisms, such as electroencephalography (EEG) headsets.

Figure 2:
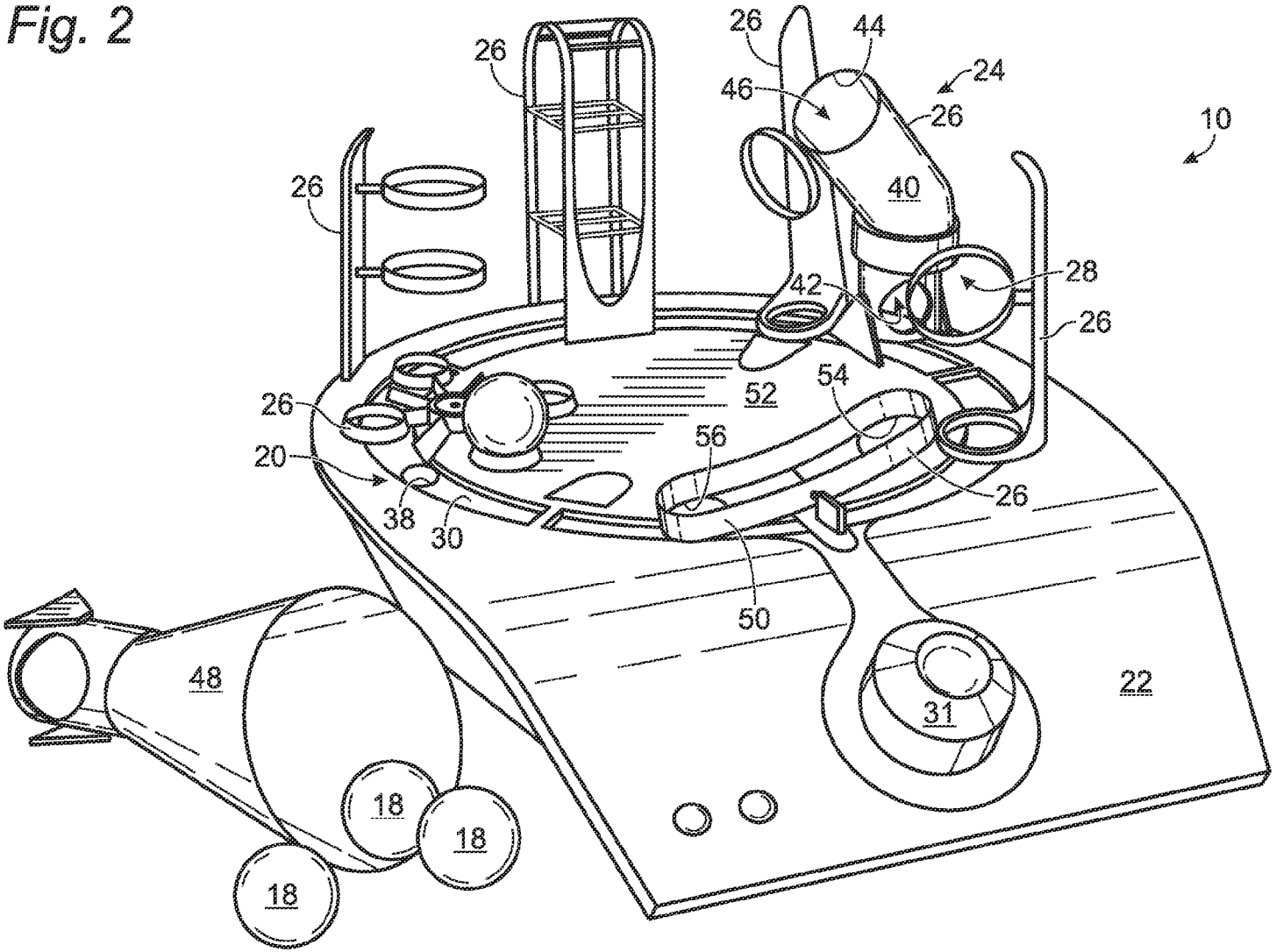
FIG. 2 shows an example mind-control toy that includes an aerial obstacle course.

In the embodiment shown in FIG. 2, object 18 is a spherical ball that preferably is hollow and light enough to be suspended in midair using a moderate amount of wind force (e.g., a ping-pong ball). In other embodiments, object 18 may be different shapes and have different compositions. Member 16 in the embodiment of FIGS. 2-4 includes a device 20, shown particularly in FIG. 3, for suspending object 18 in midair. In this example, device 20 is a fan, but other devices capable of suspending objects in midair are also contemplated. Controller 14 is responsive to the first signal generated by biosensor 12 to vary output of device 20 to control a suspended height of object 18, for example, by increasing the velocity of a fan inside of device 20.

Figure 4:
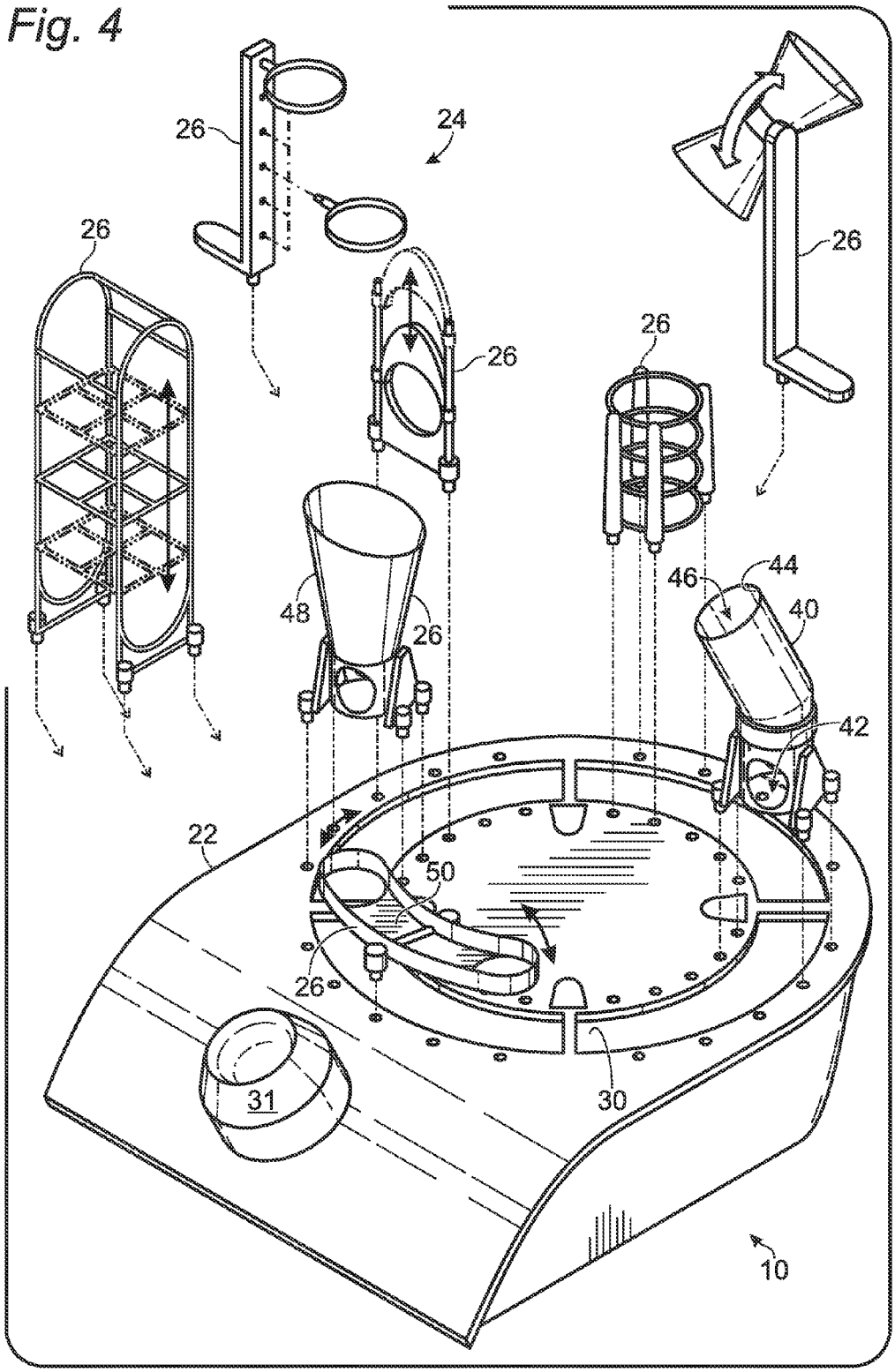
FIG. 4 is an exploded view of an obstacle course embodiment similar to that shown in FIG. 2 that depicts various obstacles and the manner of attaching those obstacles to a base structure.

The mind-control toy shown in FIG. 2 also includes a base structure 22 that may be placed on a surface such as a table top so that a user can interact with mind-control toy 10. An obstacle course 24 includes one or more obstacles 26, each of which may be removably mountable to base structure 22 so that the obstacles collectively define an aerial path 28 around and through the obstacles. Several examples of obstacles 26 are shown in FIGS. 2 and 4, and will be discussed further below.

Figure 3:
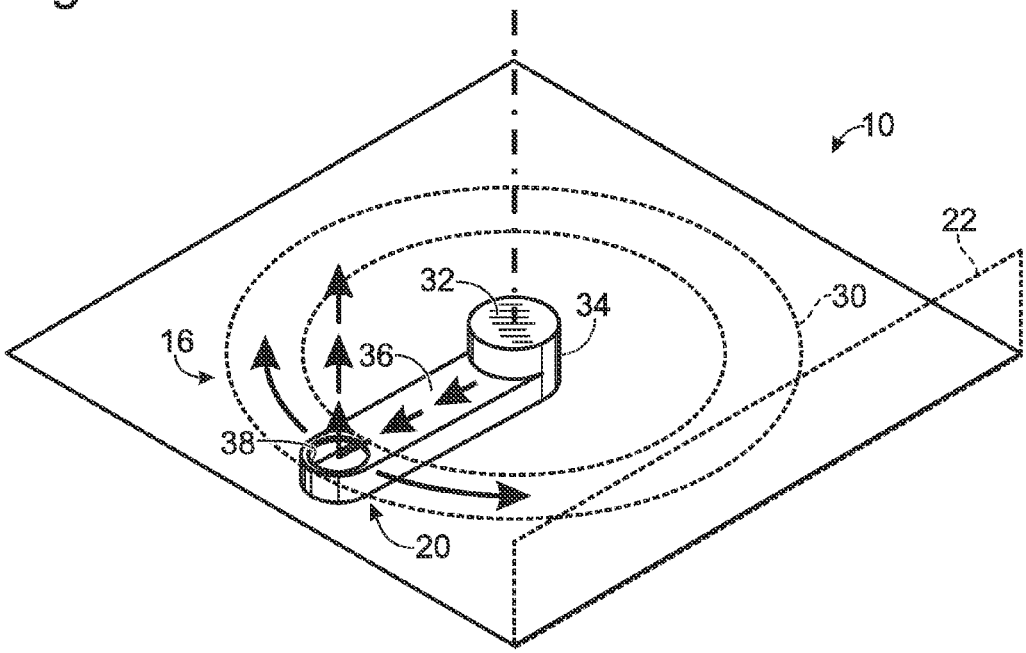
FIG. 3 is an isometric view of a levitation mechanism suitable for use with the toy shown in FIG. 2.

Device 20 may be mounted to base structure 22 so that it is movable along a pathway 30 below aerial path 28. In some examples, base structure 22 may include controls 31 that are manually operable to move device 20 along pathway 30. One example of a suitable device 20 is shown in FIG. 3. Device 20 includes a housing 32 enclosing a fan 34. Extending from housing 32 is an airflow passage 36, which terminates in an orifice 38.

Operation of fan 34 creates an air stream which may be directed through airflow passage 36 and out orifice 38. Orifice 38 may be oriented such that the air stream may be directed upwardly through orifice 38 and perpendicular to pathway 30. Controller 14 may be configured to vary the output of device 20 (e.g., vary the strength of the air stream produced by fan 34) to suspend object 18 within aerial path 28. Further explanation of device 20 may be found in U.S. Pat. No. 7,048,604, the disclosure of which was incorporated above.

As noted previously, a variety of obstacles may be removably mounted to base structure 22. For example, and referring to FIGS. 2 and 4, a launch obstacle 40 is shown defining a first opening 42 at one end, a second opening 44 at an opposite end and a passageway 46 in between. Passageway 46 may be shaped to expel object 18 through second opening 44 when device 20 is positioned below first opening 42 so that the air stream created by fan 34 and expelled through orifice 38 is further directed through passageway 46 and out second opening 44. A receiving obstacle 48 may be provided to catch object 18 after it is expelled from launch obstacle 40. In some embodiments, receiving obstacle may have a shape suitable for catching object 18, such as the funnel shape of the receiving obstacle 48 shown in FIGS. 2 and 4.

Another example obstacle that may be removably mounted to base structure 22 is a see-saw obstacle 50 that is pivotable along an axis substantially parallel to a top surface 52 of the base structure, see-saw obstacle 50 including two openings at opposite ends with diameters that are smaller than object 18 so that when object 18 is lowered into a first opening 54 of the two openings that is pivoted upwards, an end of the see-saw with the first opening pivots downwards and an opposite end of the see-saw obstacle with a second opening 56 pivots upwards.

In some embodiments, mind-control toy 10 includes a second biosensor (not shown). The second biosensor may be configured to detect second brainwave activity and generate a second signal based on the detected second brainwave activity. The second signal may be used to control various aspects of mind control toy 10. For example, controller 14 may be responsive to the second signal to move device 20 along pathway 30 below the aerial path 28, rather than a user manually moving device 20 along pathway 30.

A second biosensor may also provide for a user experience that is different than the one experienced using the aerial obstacle course 24 described above. For example, FIGS. 5-9 and FIG. 11 depict head-to-head embodiments of mind-control toys that provide the ability for two or more players to compete against one another, or in some instances, work together, using their minds. Because many of the components of these embodiments are similar, a similar numbering scheme is used (e.g., 10 above is similar to 110 below).

Figure 5:
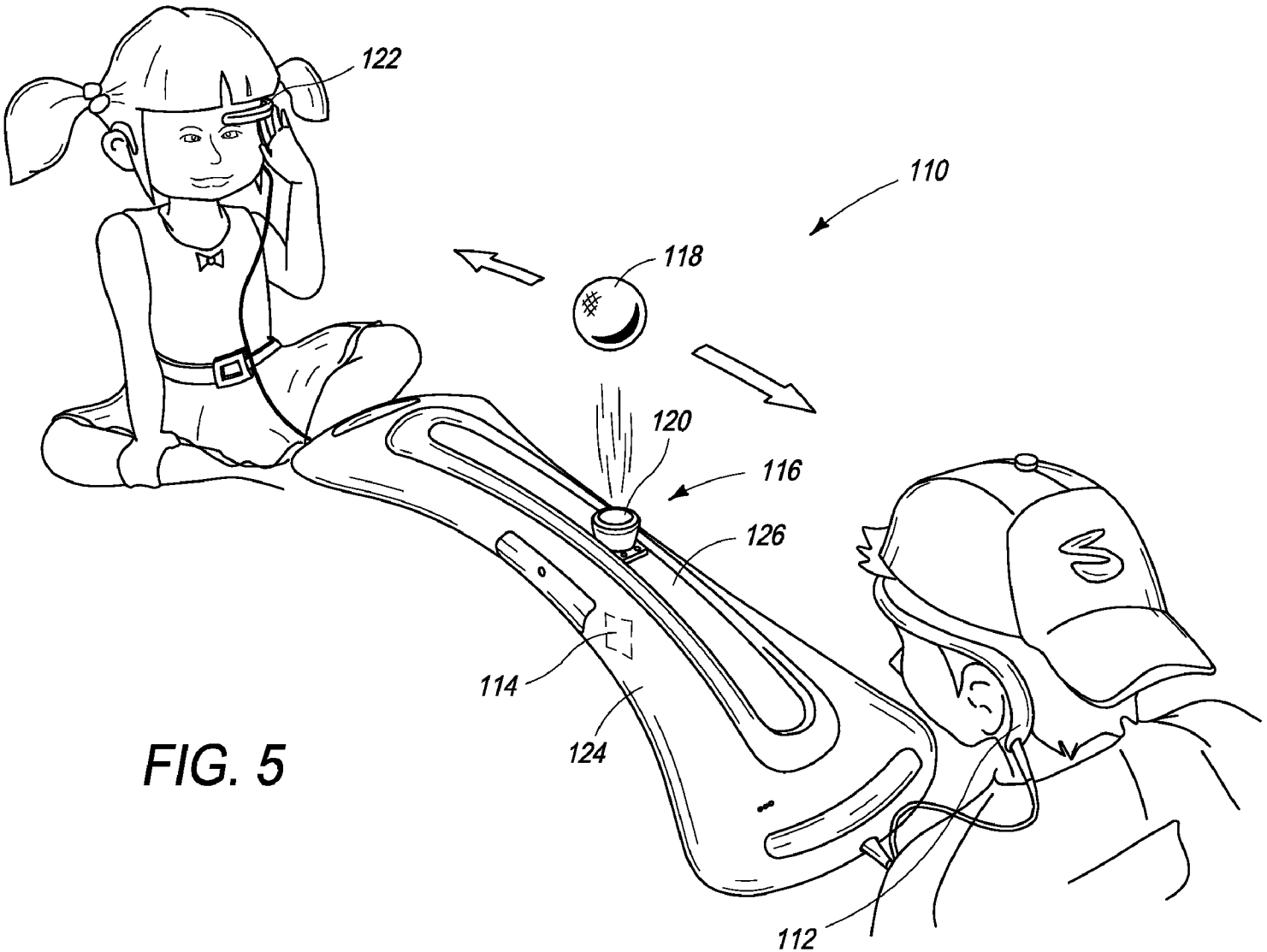
FIG. 5 depicts an embodiment of a mind-control toy that permits head-to-head competition along a track.

Referring to FIG. 5, a head-to-head competition mind-control toy 110 includes a first biosensor 112, similar to biosensor 12 described above, that is configured to detect brainwave activity and generate a first signal. A controller 114, similar to controller 14 described above, also is provided and is responsive to the first signal to direct a member 116 to effect movement of an object 118. Member 116 once again includes a device 120 for suspending object 118 in midair that includes a fan (not shown but similar to that of FIG. 3). As before, other devices for suspending objects in midair are also contemplated.

As noted above, the embodiments shown in FIGS. 5-9 include a second biosensor 122 that is configured to detects second brainwave activity (i.e., from a second player) and generate a second signal. Generating a second signal allows for competitive or cooperative play, depending on the embodiment. Examples of both are described herein and shown in the drawings.

The mind-control toy 110 of FIG. 5 is configured to competitive play. Mind-control toy 110 includes a base structure 124 with a track 126 that extends between two players, one wearing first biosensor 112 and the other wearing second biosensor 122. Although track 126 is shown in FIGS. 5-9 as being linear, it should be understood that track 126 may form other path shapes, such as circular (similar to FIGS. 1-4) or serpentine.

Controller 114 may be responsive to at least one of the signals produced by first biosensor 112 and second biosensor 122 to vary output of device 120 to control a suspended height of object 118. For example, in some embodiments, controller 114 is responsive to both signals to cause device 120 to suspend the object to a height that is proportional to the players' combined concentration level. Additionally or alternatively, controller 114 may cause device 120 to suspend the object to a height that increases as the players' concentration levels approach one another.

Controller may additionally or alternatively be responsive to at least one of the signals produced by first biosensor 112 and second biosensor 122 to alter the location of device 220 on track 126. For example, in FIG. 5 the biosensors are associated with opposite ends of track 126. In some such examples, controller 114 is responsive to signals from both biosensors to cause device 120 to move along track 126 towards an end of track 126 associated with the biosensor that is detecting the strongest brainwave activity. In other words, the player that is able to concentrate the hardest is able to bring device 120 towards their end for the win (similar to tug-o-war). In other embodiments, controller 114 is responsive to signals from both biosensors to cause device 120 to move along track 126 towards an end of track 126 associated with the biosensor that is detecting the weakest brainwave activity. The player that concentrates the hardest wins again, but this time they push device 120 towards the other player. In manners such as these, players may compete, with the player that is able to concentrate the hardest typically being the winner.

In some head-to-head and/or cooperative embodiments, such as those shown in FIGS. 6-9, players may each control their own member to suspend their own object above a device. For example, in FIGS. 6 and 7, mind control toy 110 includes a second member 128 for effecting movement on a second object 130. Second member 128 may include a second device 132 for suspending second object 130 in midair above second device 132. In order to provide each player with control of a member, controller 114 may be responsive to a signal from one of first and second biosensors 112, 122 to move first device 120 along track 126, and may be responsive to the signal from the other of first and second biosensors 112, 112 to move the other, second device 132 along track 126.

Figure 6:
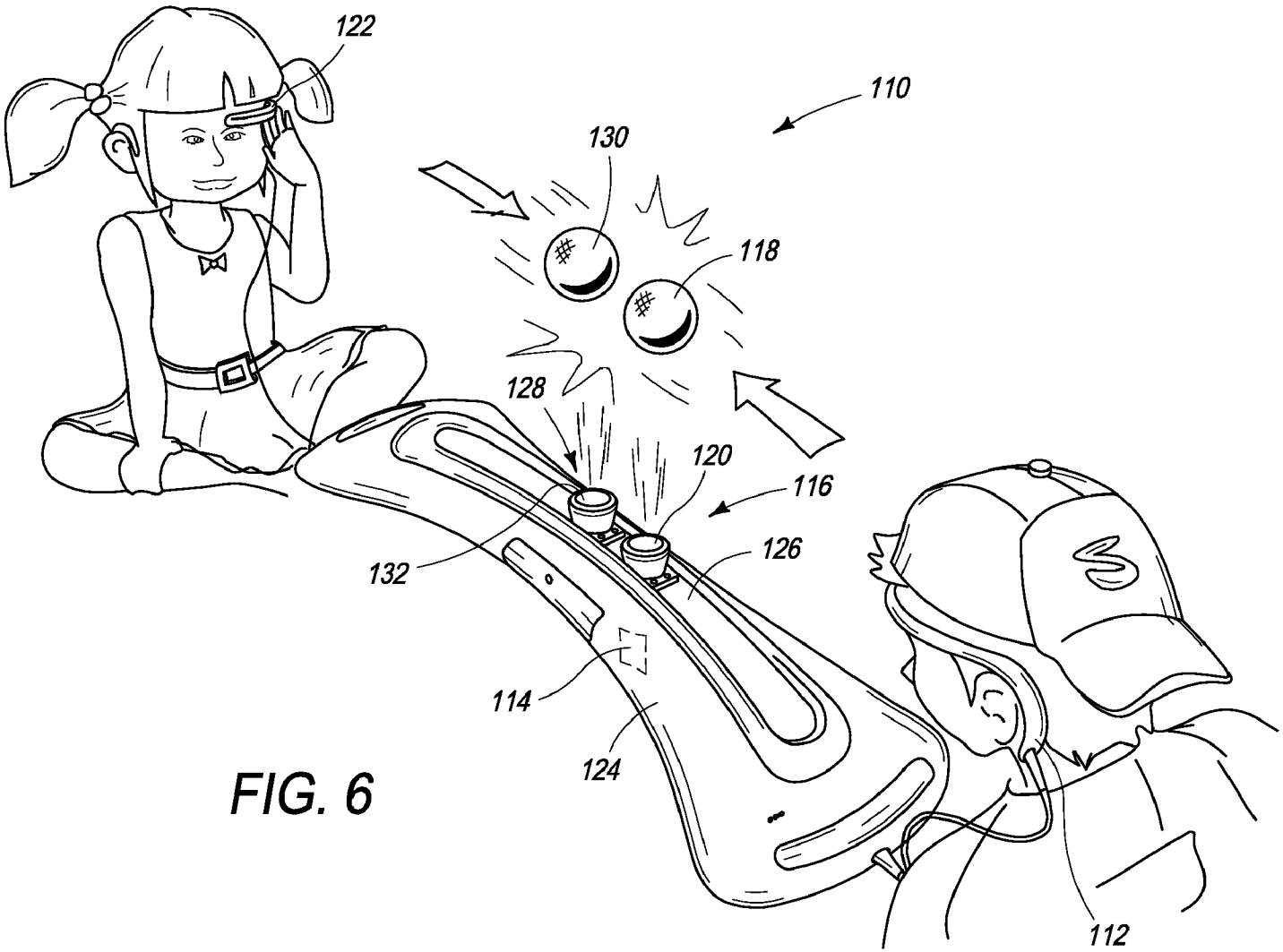
FIG. 6 depicts an embodiment similar to that of FIG. 5 that includes two devices for suspending an object in midair.

In FIG. 6, first device 120 and second device 132 are shaped so that when they are close enough to one another, or they collide, the objects (118, 130) that they are suspending are likely to collide when at similar suspended heights. Accordingly, players can compete to attempt to knock the other player's object out from above device 120 or 132.

Figure 7:
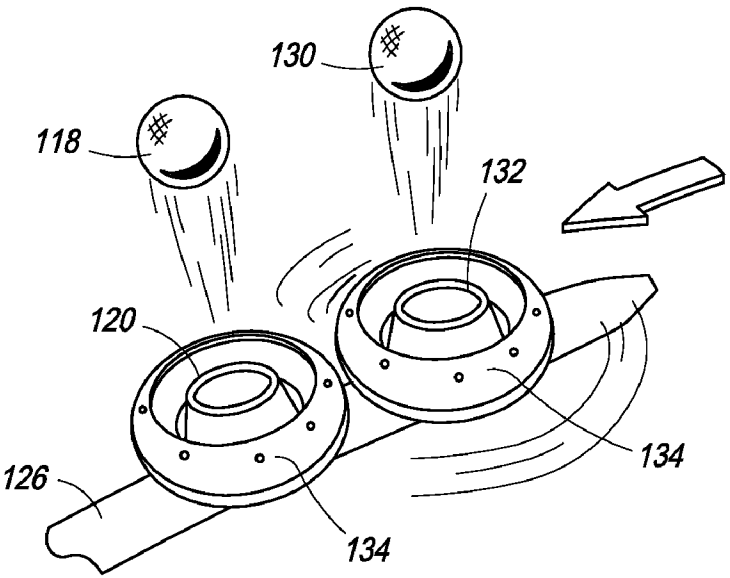
FIG. 7 depicts an embodiment similar to that of FIG. 6, except each device includes a bumper.

FIG. 7 depicts another embodiment, similar to the one shown in FIG. 6, except that first device 120 and second device 132 each include a bumper 134. Bumpers may allow first device 120 and second device 132 to collide without affecting levitation of objects 118 or 130. In some cases, bumpers 134 may be translucent or even transparent, and may include a collision detector (not shown) and a light source (e.g., LED) that flashes when bumper 134 is involved in a collision (e.g., with another bumper 134).

Figure 8:
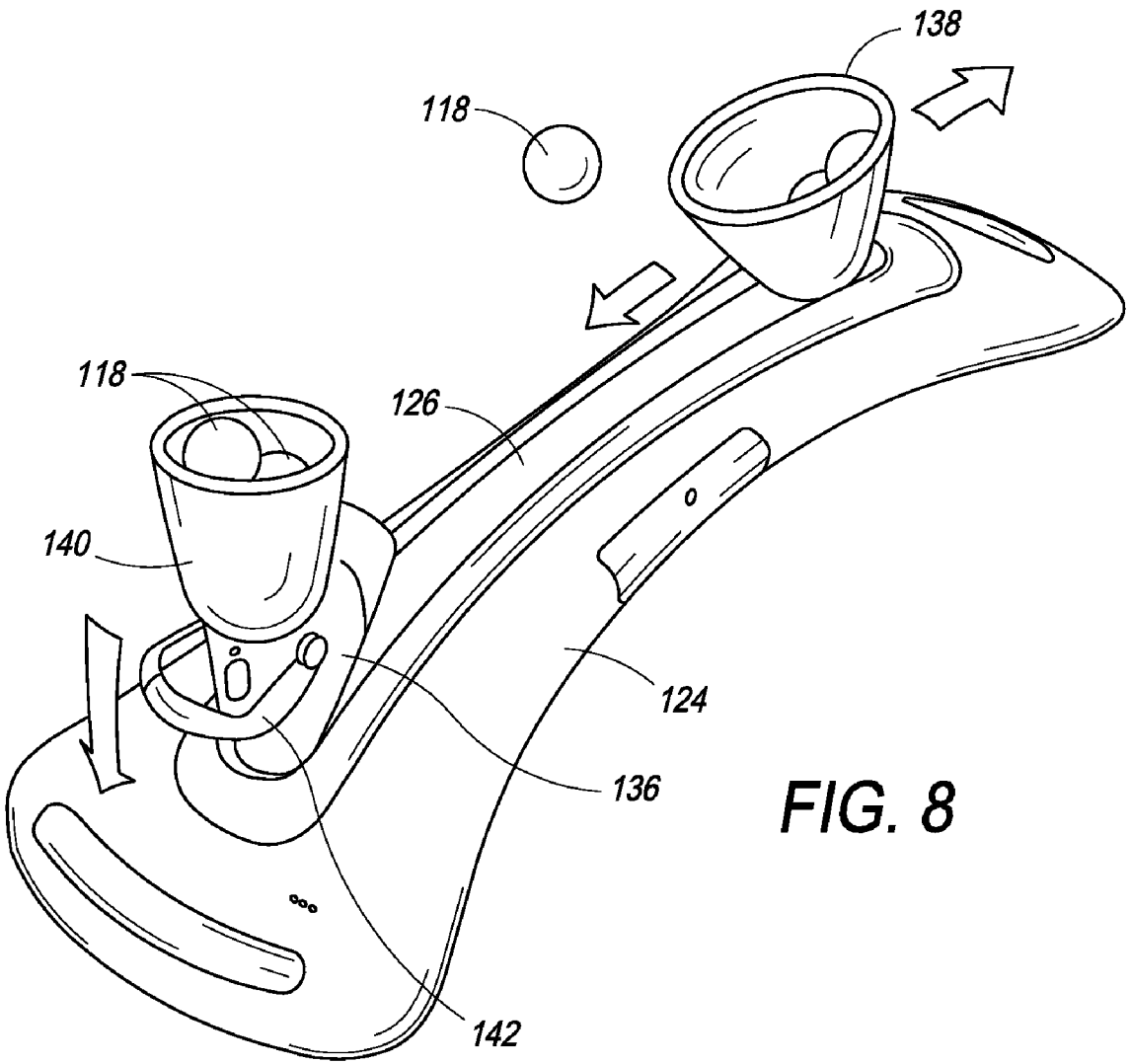
FIG. 8 depicts an embodiment similar to that of FIG. 5, further including a launcher and a receiving that are mountable along the track.

FIG. 8 depicts another embodiment that includes a launcher 136 and a receiver 138 that are somewhat similar to the launch obstacle 40 and receiving obstacle 48 of FIGS. 1-4. Here, launcher 136 and/or receiver 138 may be movable along track 126, either in response to signals received from biosensors (112, 122) or in response to manual commands received at manual controls 148. After placing object 118 into launcher 136 (e.g., by loading a supply of objects into a basket 140), a player may "power up" launcher 136 to a certain level by concentrating while wearing a biosensor. Once launcher 136 is powered up, the player may actuate a trigger 142 to allow object 118 to be released and launched from launcher 136. Receiver 138 may be moved along track 126 (using mind or manual control) to catch object 118 after it is launched from launcher 136.

Figure 9:
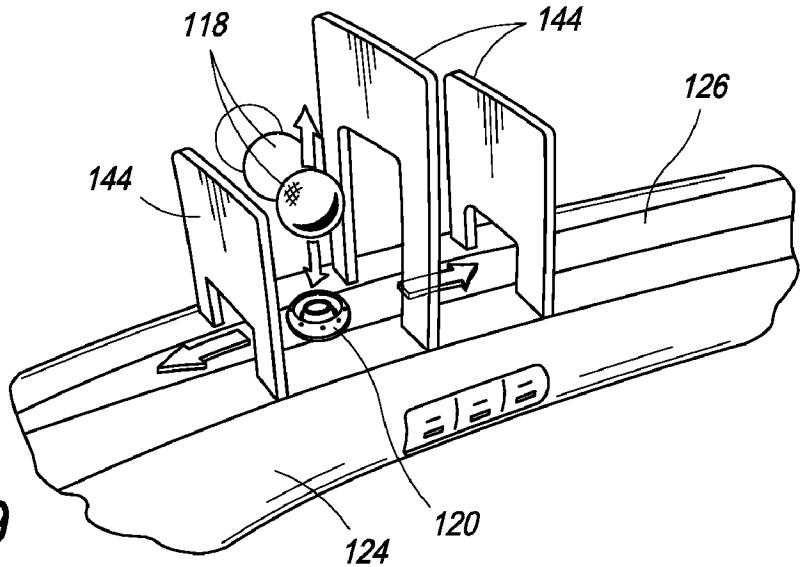
FIG. 9 depicts an embodiment similar to that of FIG. 5 that includes an obstacle course that defines an aerial path, similar to the embodiments of FIGS. 1-4.

In yet another embodiment shown in FIG. 9, obstacles 144 may be placed on track 126 to form an aerial path. Players may then navigate object 118 through the aerial path in a manner similar to the embodiments of FIGS. 1-4. Obstacles 144 may be removable from track 126, and may be of various levels of complexity, from the simple barriers shown in FIG. 9, to the more complex obstacles described above and shown in FIGS. 1-4.

FIGS. 10-13 show embodiments of mind-control toy 10 that each includes a maze in which a player may maneuver objects by causing at least a portion of the maze to rotate in response to brainwave activity, thereby reorienting and/or reconfiguring the maze to allow objects to transit the maze by gravitational force.

Figure 10:
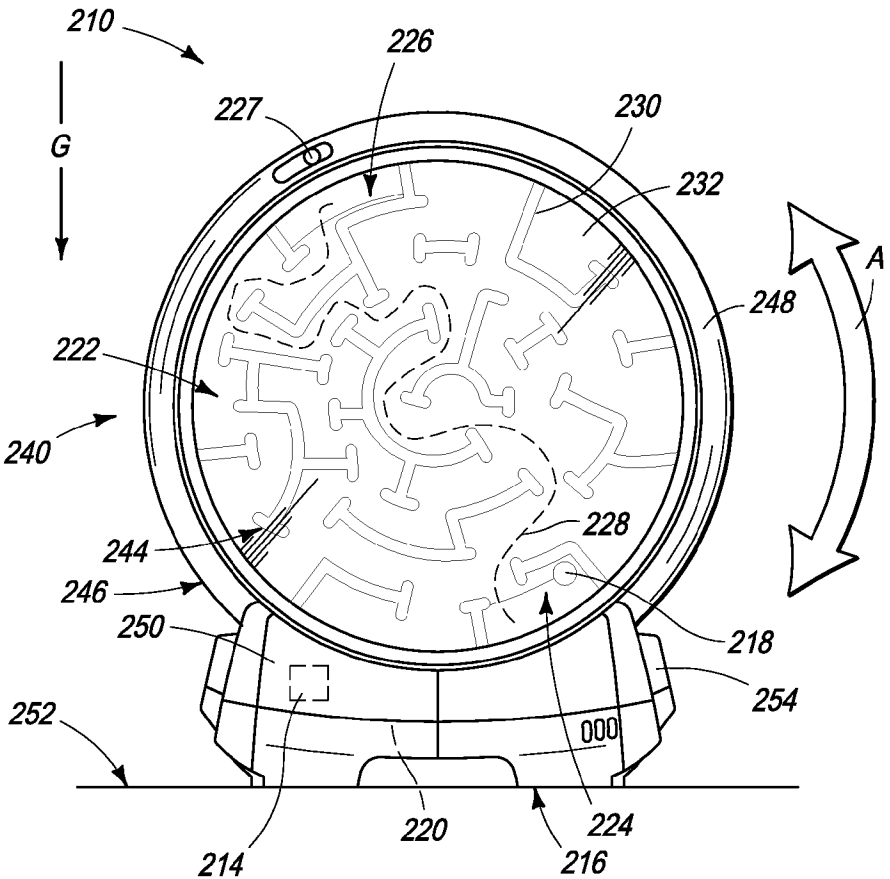
FIG. 10 depicts an example of a mind-control toy that includes a rotating water maze.

FIG. 10 depicts a mind-control toy 210 including a controller 214 responsive to a first signal generated by a biosensor, not shown in FIG. 10, but similar to those described above. Controller 214 directs a member 216 to maneuver object 218 by causing a rotation of at least a portion of the maze 222. Object 218 is configured to have a size, shape, and density enabling it to transit at least a portion of maze 222 under gravitational force G. In the embodiment of FIG. 10, object 218 is a spherical ball. In other embodiments, object 218 may be different shapes.

Member 216 includes a device 220 configured to be capable of changing a rate of rotation (indicated at A) of maze 222. Device 220 may include a motor-driven wheel, but other means capable of changing the rate of rotation of maze 222 are contemplated. In some embodiments, controller 214 is responsive to the first signal generated by biosensor 212, and directs member 216 to vary output of device 220, which varies a rate of rotation of maze 222.

In preferred embodiments of mind-control toy 210, maze 222 includes a start zone 224 and an end zone 226, and a plurality of paths (an example of which is indicated at 228) along which object 218 may move between start zone 224 and end zone 226. Paths 228 are preferably interconnected, or "branched", as shown in FIG. 10. However, in some embodiments, maze 222 may lack a defined start zone and end zone, and/or may include one or more unbranched paths 228, which may be called a labyrinth.

Start zone 224 may include a first object detector, such as an optical sensor, capable of detecting object 218 to generate a first timing mark when object 218 leaves start zone 224. In some examples, the first timing mark may be generated by a start switch 227, shown by example in FIG. 10. End zone 226 may include a second object detector, such as an optical sensor, capable of detecting object 218 to generate a second timing mark when object 218 enters end zone 226. Mind-control toy 210 may also include a timer to measure an elapsed time after a first timing mark, and a timing display capable of reporting the elapsed time after a first timing mark and/or the elapsed time between a first timing mark and a second timing mark for object 218 to transit maze 222 from start zone 224 to end zone 226.

Paths 228 in maze 222 may be delimited by one or more barriers 230 that block movement of object 218. Barriers 230 may be configured as walls having linear and/or curvilinear geometry, as shown in FIG. 10, or as posts, fences, or other impediments to movement of object 218. Barriers 230 having gaps or other openings that allow passage of object 218 may be incorporated as means to configure maze 222 as a plurality of branched paths 228.

Barriers 230 may be disposed in fixed positions by attachment to a single maze substrate 232. A maze having changeable paths delimited by moveable barriers 230 is particularly described below as an alternative preferred embodiment.

Maze 222 is preferably configured in two dimensions, which may be rotated about a substantially horizontal axis. Such rotation may occur in a substantially vertical plane and may bring at least a portion of a path 228 substantially into alignment with the gravitational force G, to maneuver object 218 from start zone 224 toward end zone 226. Nevertheless, embodiments of mind-control toy 210 consistent with the present disclosure may include a maze 222 configured in three dimensions, and means for controlling rotation of maze 222 about more than one axis, to facilitate a transit of object 218 through maze 222 motivated by gravitational force G.

Preferably, mind-control toy 210 includes a frame or chamber 240 configured to enclose object 218 within maze 222. Preferably, chamber 240 is further configured to hold a fluid 242, such that maze 222 may be filled with fluid 242, and object 218 may be required to maneuver through fluid 242 during transit of maze 222. Fluid 242 is preferably water or an aqueous solution. However, in some examples, fluid 242 may be a fluid medium that has density, viscosity, and/or optical properties different from water. In some examples, chamber 240 may be configured to hold a gas, such as air.

Accordingly, object 218 may have different compositions and different densities compatible with gravitational movement in the fluid 242 or other medium which is used to fill maze 222. In one embodiment, object 218 is particularly configured to have a density low enough to float in fluid 242 in response to gravitational force G, such that object 218 transits the fluid-filled maze 222 by ascending from lower positions to higher positions. For example, object 218 may be composed of a low-density plastic or other light and water-resistant material. However, in some examples, object 218 may be configured to have a density high enough for it to transit maze 222 by descending from higher positions to lower positions under gravitational force G.

Figure 11:
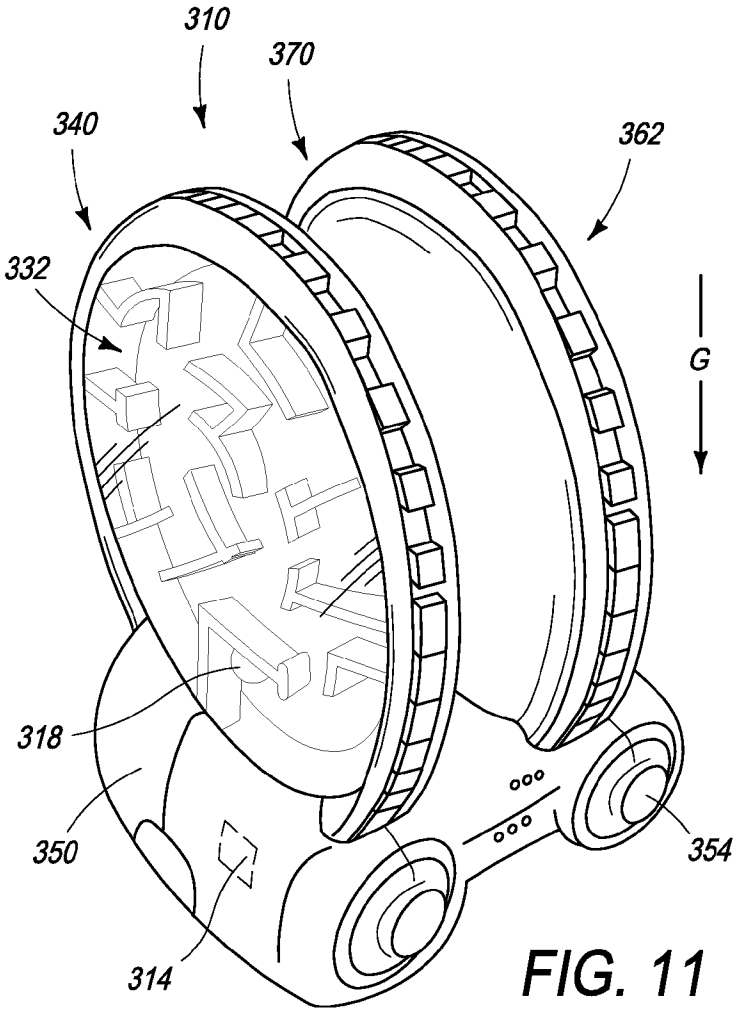
FIG. 11 depicts an embodiment similar to that of FIG. 10 which includes two rotating water mazes suitable for a competitive mode of play.

As shown in FIG. 10, and further depicted for a related embodiment in FIG. 11, chamber 240 may have a substantially planar, or disc-like shape, including a first front face 244 and a circumferential edge 246. Front face 244 is preferably transparent, to allow observation of object 218 in maze 222. Front face 244 may be bordered by a margin 248, to which edge 246 is joined. Edge 246 and/or margin 248 may be configured to facilitate the ability of device 220 to rotate maze 222, as described below.

Mind-control toy 210 preferably includes a base structure 250 configured to moveably hold chamber 240 in a vertical orientation substantially aligned with the gravitational force G. Base structure 250 may rest on a flat surface 252, such as a table, to enable a player to interact with mind-control toy 210. To enable chamber 240 to be removably mounted on base 250, base 250 may support chamber 240 along a lower portion of edge 246 and/or margin 248.

Base structure 250 may be further configured to operationally couple device 220 and chamber 240. In a preferred embodiment, base structure 250 holds chamber 240 in a vertical orientation, and device 220 is configured to rotate chamber 240 including maze 222 about a substantially horizontal axis, such that a portion of path 228 between start zone 224 and end zone 226 may become substantially aligned with the gravitational force G. In some examples, device 220 may interact with edge 246 to control rotation of chamber 240. In some examples, device 220 may interact with margin 248 to control rotation of chamber 240.

Chamber 240 may include modifications to facilitate control by device 220. In some examples, chamber 240 may have external notches, grooves, or teeth, as shown in the embodiment of FIG. 11. In some examples, surface of edge 246 and/or margin 248 may have a rough texture and/or be covered by a non-slip material, such as rubber.

Mind-control toy 210 may include a manually operated switch 254 configured to cause device 220 to reverse a direction of rotation of chamber 240 and maze 222. Switch 254 may be mounted on base structure 250, as shown in FIG. 10. A player may use switch 254 to reverse the direction of rotation of maze 222 while separately controlling the rate of rotation of maze 222 by means of brainwave activity detected by biosensor 212.

FIG. 11 depicts an embodiment of mind-control toy 310 which is similar to the maze mind-control toy 210 described previously but that is further configured to be suitable for a head-to-head competition between two players. Similar to above, mind-control toy 310 includes a controller 314 and provides for traversal of an object 318 through a first maze 322 having a first start zone 324 and a first end zone 326. Mind-control toy 310 may include a first chamber 340 configured to enclose first object 318 in first maze 322.

In addition, mind-control toy 310 includes a second maze 362, which may be similar to (and in some cases, nearly identical to) first maze 322, having a second start zone and end zone (which cannot be seen in FIG. 11), a second object (also not visible in FIG. 11) configured to transit second maze 362 using gravitational force G, and a second chamber 370 configured to enclose second object 368 in second maze 362.

Mind-control toy 310 may include a first biosensor to detect a first brainwave activity, as from a first player, and generate a first signal, similar to biosensor 212 above. In addition, a second biosensor may be provided to detect a second brainwave activity, as from a second player, and generate a second signal. Similar to controller 214 described above, controller 314 may respond to the first signal to direct movement of first object 318 in first maze 322 by controlling a rate of rotation of first chamber 340. Controller 314 may also respond to the second signal to direct member 316 to effect movement of second object in second maze 362 by controlling a rate of rotation of second chamber 370.

Mind-control toy 310 may include a base structure 350, similar to base structure 250 above, configured to movably hold chamber 340 in a rotatable manner, and further configured to movably hold second chamber 370 in a rotatable manner. Base structure 350 may include a manually operated switch 354. A player may use switch 354 to reverse the direction of rotation of maze 322 while separately controlling the rate of rotation of maze 320 by means of brainwave activity detected by a biosensor. A similar switch 354 may be provided to allow a competitor to reverse the direction of rotation of second maze 362. Preferably, chambers 340 and 370 are held in vertical orientations, disposed back-to-back, as shown in FIG. 11, and each is rotated about a horizontal axis, as described for chamber 240 above.

Figure 12:
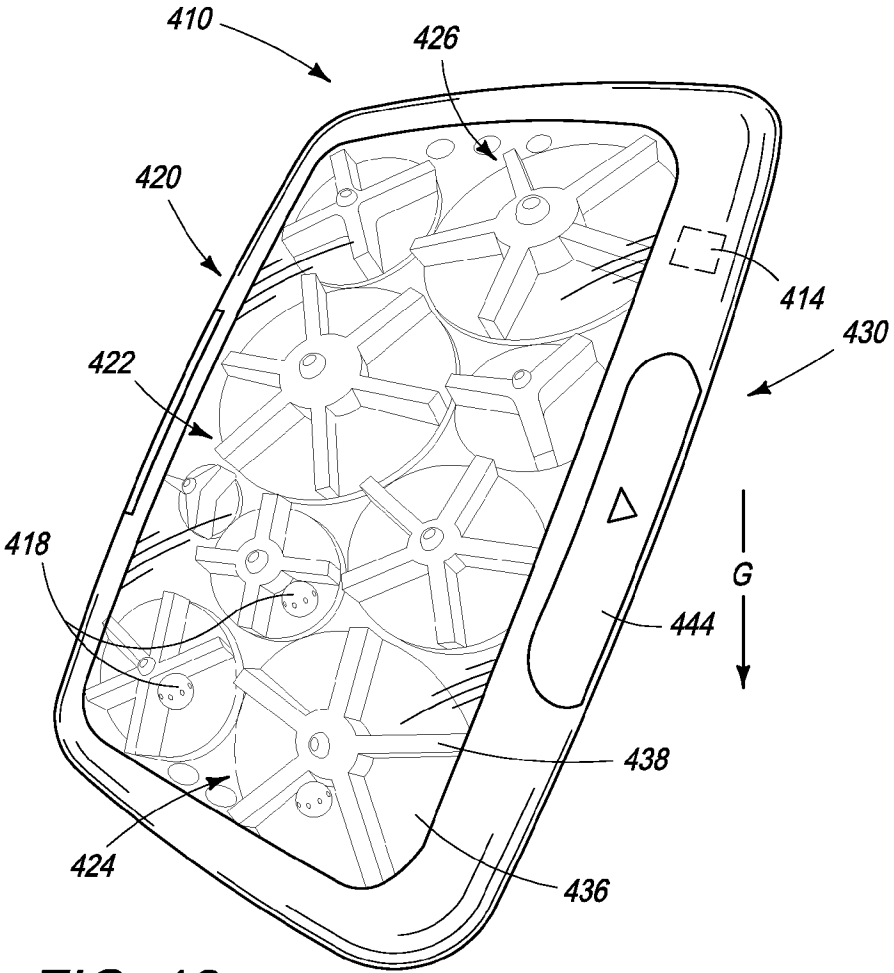
FIG. 12 depicts an example of a mind-control toy that includes a water maze formed by rotating discs.

FIG. 12 depicts as a further embodiment a mind-control toy 410 including a plurality of rotatable discs 420 that, through sideways interactions, form a variable maze 422 having a start zone 424 and an end zone 426. Maze 422 may contain multiple start zones 424 and multiple end zones 426, as shown in FIG. 12. In some examples of mind-control toy 410, the start zones 424 and end zones 426 may be operationally interchangeable upon inversion of maze 422. Mind-control toy 410 further includes one or more objects 418 configured to occupy maze 422 and transit between start zone 424 and end zone 426 using gravitational force G.

Similar to above, mind-control toy 410 includes a biosensor (not shown) that detects brainwave activity, as produced by a player, and that produces a signal based on the detected brainwave activity. Mind-control toy 410 also includes a controller 414 configured to respond to the signal to direct movement of one or more objects 418 in maze 422 by controlling a rate of rotation of one or more discs 420. Rate of rotation of discs 420 may be controlled using one or more of a motorized wheel, gear, and or pulley.

In a preferred embodiment, mind-control toy 410 includes a chamber 440 configured to hold a fluid medium, such as water or aqueous solution, and at least one object 418 configured to float in the fluid, similar to object 218 of mind-control toy 210 described above. In such embodiment, the object 418 transits the maze from lower positions to higher positions. However, in some examples, at least one object 418 may be configured to have a higher density than the fluid medium, such that it transits maze 422 from higher positions to lower positions. In some examples, chamber 440 may hold a gas, such as air.

Figure 13:
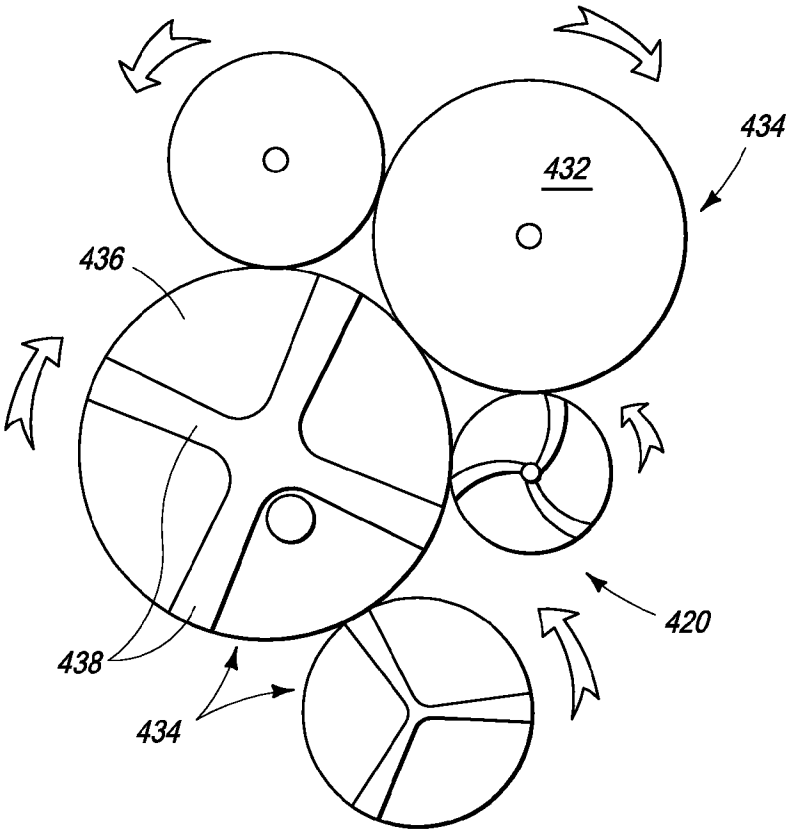
FIG. 13 depicts an embodiment of rotating discs suitable for use with the toy in FIG. 12.

As shown in FIG. 12 and more particularly shown in FIG. 13, discs 420 may have a substantially planar first face 432 and a substantially circular disc edge 434. Each first face 432 may further comprise a recessed substrate 436 and one or more raised barriers 438 fixed to the substrate 436. In a preferred embodiment of toy 410, the raised barriers 438 radiate generally from a center of the first face 432 to substantially adjacent disc edge 434, such that the first face 432 of each disc 420 constitutes a portion of maze 422.

Preferably, the plurality of discs 420 are arranged with edges 434 juxtaposed to each other, such that an edge 434 of each disc 420 is juxtaposed with an edge 434 of one or more other discs 420. Accordingly, the configuration of maze 422 results from particular alignment and/or misalignment of barriers 438 on first faces 434 of adjacent discs 420. Furthermore, rotation of one or more discs 420 changes the configuration of maze 422 by varying a path by which an object may transit maze 410 between the start zone 424 and end zone 426.

Each of the plurality of discs 420 may have a particular diameter, a rate of rotation, and may rotate either in a clockwise direction or a counterclockwise direction. As shown in FIGS. 12-13, maze 422 may include a plurality of discs 420 having different diameters. Maze 422 also may include a plurality of discs 420 rotating in both a clockwise direction and a counterclockwise direction. In some examples, adjacent discs may have opposite directions of rotation, as shown in FIG. 13. In some examples, discs 420 may rotate all in the same direction. In some examples, discs 420 may have the same rate of rotation. In some examples, discs 420 may have regular diameters and/or different rates of rotation The embodiment shown in FIG. 12 includes a manually-operated switch 444 mounted on chamber 440. In some examples, switch 444 is operable to reverse a direction of rotation of one or more of discs 420. In some examples, chamber 440 may be supported in a substantially vertical orientation by a stand (not shown). In some examples, chamber 440 may be held in the player's hand.

While embodiments of a toy and methods of toy play have been particularly shown and described, many variations may be made therein. This disclosure may include one or more independent or interdependent embodiments directed to various combinations of features, functions, elements and/or properties. Other combinations and sub-combinations of features, functions, elements and/or properties may be claimed later in a related application. Such variations, whether they are directed to different combinations or directed to the same combinations, whether different, broader, narrower or equal in scope, are also regarded as included within the subject matter of the present disclosure. Accordingly, the foregoing embodiments are illustrative, and no single feature or element, or combination thereof, is essential to all possible combinations that may be claimed in this or a later application. Each example defines an embodiment disclosed in the foregoing disclosure, but any one example does not necessarily encompass all features or combinations that may be eventually claimed. Where the description recites "a" or "a first" element or the equivalent thereof, such description includes one or more such elements, neither requiring nor excluding two or more such elements. Further, ordinal indicators, such as first, second or third, for identified elements are used to distinguish between the elements, and do not indicate a required or limited number of such elements, and do not indicate a particular position or order of such elements unless otherwise specifically stated.

What is claimed is:

1. A mind-control toy, comprising:

a base structure;

an obstacle course that is removably mountable to the base structure to define an aerial path;

a biosensor configured to detect brainwave activity and generate a first signal based on the detected brainwave activity; and a controller responsive to the first signal to direct a member to effect movement of an object;

wherein the member includes a device for suspending the object in midair above the device, wherein the device is mounted to the base structure so that it is movable along a pathway below the aerial path; and wherein the controller is configured to vary the output of the device to suspend the object within the aerial path and the controller is responsive to the first signal to vary output of the device to control a suspended height of the object.

2. The mind-control toy of claim 1, wherein the obstacle course includes:

a launch obstacle defining first and second openings at opposite ends and a passageway in between, the passageway being shaped to expel the object through the second opening when the device is positioned below the first opening; and a receiving obstacle shaped to catch the object after it is expelled from the launch obstacle.

3. The mind-control toy of claim 1, wherein the obstacle course includes a see-saw obstacle that is pivotable along an axis substantially parallel to a top surface of the base structure, the see-saw obstacle including two openings at opposite ends with diameters that are smaller than the object so that when the object is lowered into a first opening of the two openings that is pivoted upwards, an end of the see-saw with the first opening pivots downwards and an opposite end of the see-saw obstacle pivots upwards.

4. The mind-control toy of claim 1, further comprising:

a second biosensor configured to detect second brainwave activity and generate a second signal based on the detected second brainwave activity;

wherein the controller is responsive to the second signal to move the device along the pathway below the aerial path.

5. The mind-control toy of claim 1, further comprising:

a maze having a start zone and an end zone;

wherein the member includes a device configured to rotate at least a portion of the maze to maneuver the object from the start zone to the end zone using a gravitational force.

6. The mind-control toy of claim 5, wherein the controller is responsive to the first signal to vary output of the device to control a rate of rotation of the portion of the maze.

7. The mind-control toy of claim 5, further comprising:

a chamber configured to enclose the maze; and a base structure configured to moveably hold the chamber;

wherein the device is configured to rotate the chamber on the base structure about a substantially horizontal axis such that at least a portion of a path between the start zone and the end zone is substantially aligned with the gravitational force.

8. The mind-control toy of claim 7, wherein the chamber is further configured to hold fluid, and wherein the object is configured to float in the fluid to transit the maze using the gravitational force.

9. The mind-control toy of claim 5, further comprising a manually-operated switch mounted on the base structure and operable to cause the device to reverse a direction of rotation of the portion of the maze.

10. The mind-control toy of claim 5, further comprising:

a second biosensor configured to detect second brainwave activity and generate a second signal based on the detected second brainwave activity;

a second maze having a second start zone and a second end zone;

a second member that includes a second device configured to rotate at least a portion of the second maze to maneuver a second object between the second start zone and the second end zone using a gravitational force.

11. The mind-control toy of claim 5, wherein the maze further comprises a plurality of rotatable discs each having at least a first face and an edge, the first face configured as a portion of the maze and the edge juxtaposed with an edge of one or more other rotatable discs, such that rotation of one or more rotatable discs varies a path between the start zone and the end zone; and the device is configured to rotate one or more of the rotatable discs.

12. The mind-control toy of claim 11, wherein one or more rotatable discs rotate in opposite directions.

13. The mind-control toy of claim 11, wherein the plurality of rotatable discs include a range of diameters.

14. The mind-control toy of claim 1, further comprising a second biosensor configured to detect second brainwave activity and generate a second signal based on the detected second brainwave activity.

15. The mind-control toy of claim 14, wherein the member includes a device for suspending the object in midair above the device, and the controller is responsive to at least one of the signals to vary output of the device to control a suspended height of the object.

16. A mind-control toy comprising:

a biosensor configured to detect brainwave activity and generate a first signal based on the detected brainwave activity;

a second biosensor configured to detect second brainwave activity and generate a second signal based on the detected second brainwave activity;

a controller responsive to the first signal to direct a member to effect movement of an object; and a track, wherein the member includes a device for suspending the object in midair above the device, wherein the controller is responsive to at least one of the signals to vary output of the device to control a suspended height of the object; and wherein the controller is further configured to move the device along the track in response to at least one of the signals.

17. The mind-control toy of claim 16, further comprising:

an obstacle that is removably mountable to the track to define an aerial path;

wherein the controller is responsive to at least one of the signals to vary the output of the device to suspend the object within the aerial path.

18. The mind-control toy of claim 16, further comprising:

a second member including a second device for suspending a second object in midair above the second device;

wherein the controller is configured to move the second device along the track in response to at least on of the signals.

19. The mind-control toy of claim 16, wherein the biosensors are associated with opposite ends of the track, and the controller is further configured to move the device towards an end of the track associated with the biosensor that is detecting the strongest brainwave activity.

20. The mind-control toy of claim 16, further comprising:

a launcher mounted to the track and including a fan that is responsive to at least one of the signals to expel the object; and a receiver that is movable along the track and that is shaped to catch the object after it is expelled from the launcher.

21. A mind-control toy, comprising:

a first biosensor configured to detect first brainwave activity and generate a first signal based on the detected first brainwave activity;

a second biosensor configured to detect second brainwave activity and generate a second signal based on the detected second brainwave activity;

a device for suspending an object in midair above the device; and a controller responsive to at least one of the first and second signals to vary output of the device to control a suspended height of the object.

22. A mind-control toy, comprising:

a biosensor configured to detect brainwave activity and generate a first signal based on the detected brainwave activity;

a controller responsive to the first signal to direct a member to effect movement of an object;

a chamber enclosing a maze having a start zone and an end zone; and a base structure configured to moveably hold the chamber;

wherein the member includes a device configured to rotate at least a portion of the maze to maneuver the object from the start zone to the end zone;

wherein the controller is responsive to the first signal to vary output of the device to control a rate of rotation of the portion of the maze;

wherein the device is configured to rotate the chamber on the base structure about a substantially horizontal axis such that at least a portion of a path between the start zone and the end zone is substantially aligned with the gravitational force.

* * * * *